US008418862B2

(12) United States Patent
Liu et al.

(10) Patent No.: US 8,418,862 B2
(45) Date of Patent: Apr. 16, 2013

(54) SEMI-PERMANENT VEHICLE COUPLER FOR LIGHT RAIL

(75) Inventors: Fenggang Liu, Shandong (CN); Jie Yang, Shandong (CN); Minggang Li, Shandong (CN)

(73) Assignee: Qingdao Sifang Rolling Stock Research Institute Co., Ltd., Shandong (CN)

( * ) Notice: Subject to any disclaimer, the term of this patent is extended or adjusted under 35 U.S.C. 154(b) by 0 days.

(21) Appl. No.: 13/172,811

(22) Filed: Jun. 29, 2011

(65) Prior Publication Data

US 2011/0253663 A1 Oct. 20, 2011

Related U.S. Application Data

(63) Continuation of application No. PCT/CN2010/074448, filed on Jun. 25, 2010.

(30) Foreign Application Priority Data

Nov. 9, 2009 (CN) ..... 2009 1 0210737

(51) Int. Cl.
*B61G 5/00* (2006.01)

(52) U.S. Cl.
USPC ..... 213/75 R

(58) Field of Classification Search ..... 213/7–9, 213/22–24, 31, 32 R, 40 R–42, 62 R–64, 213/75 R–77, 220, 221
See application file for complete search history.

(56) References Cited

U.S. PATENT DOCUMENTS 7,537,127 B2 * 5/2009 Hogbring ..... 213/62 R
2009/0039044 A1 2/2009 Krause ..... 213/64

FOREIGN PATENT DOCUMENTS

CN 2880620 Y 3/2007

(Continued)

OTHER PUBLICATIONS

International Search Report of International Application PCT/CN2010/074448, dated Oct. 21, 2010.
Jun Zhang et al., "Study on Home-made New Tight-Lock Coupler for the City Truck Traffic" Railway Locomotive & Car, XP008151407, vol. 23, No. 6, Dec. 1, 2003, pp. 35-39.

(Continued)

*Primary Examiner* — R. J. McCarry, Jr.
(74) *Attorney, Agent, or Firm* — J.C. Patents

(57) ABSTRACT

The present invention relates to a semi-permanent vehicle coupler for a light rail, which comprises a buffer end and a buffer-free end. The buffer end comprises a buffer, a joint bearing connected with the buffer and a mounting seat, wherein the joint bearing is connected with the mounting seat through a coupler yoke key; the buffer-free end comprises a left pull ring, a joint bearing connected with the left pull ring and a mounting seat, wherein the joint bearing is connected with the mounting seat through a coupler yoke key; the buffer is a double-acting buffer and comprises a shell, a left end cover, a right pull ring, elastic bodies, a central shaft and a middle partition plate, wherein the central shaft passes through the centers of the left end cover and the right pull ring and is glidingly contacted with the left end cover and the right pull ring, one end of the central shaft extends out of the left end cover, the middle partition plate is fixedly arranged on the central shaft and divides the inner part of the shell into two elastic body accommodating cavities, and the elastic bodies are positioned in the two elastic body accommodating cavities; and the other end of the left pull ring is provided with a lug boss, one end of the central shaft extending out of the left end cover is also provided with a lug boss, and the two lug bosses are connected through a connecting ring.

20 Claims, 2 Drawing Sheets

FOREIGN PATENT DOCUMENTS

| | | |
|---|---|---|
| CN | 101698414 | 4/2010 |
| GB | N26753 | 0/1911 |
| GB | 191026753 | 3/1911 |
| GB | 0 417 594 | 3/1991 |
| JP | 11-20695 | 1/1999 |
| WO | WO 98/15446 | 4/1998 |

OTHER PUBLICATIONS

The extended European Search Report of corresponding European Application No. 10827816.9-2442, dated Aug. 9, 2012.

* cited by examiner

SEMI-PERMANENT VEHICLE COUPLER FOR LIGHT RAIL

CROSS-REFERENCE TO RELATED APPLICATIONS

This application is a continuation of International Application No. PCT/CN2010/074448, filed on Jun. 25, 2010, which claims the priority benefit of China Patent Application No. 200910210737.5, filed on Nov. 9, 2009. The contents of the above identified applications are incorporated herein by reference in their entirety.

FIELD OF THE TECHNOLOGY

The present invention relates to a railway vehicle coupler buffering device, and particularly to a semi-permanent vehicle coupler with a buffer for a light rail.

BACKGROUND

With the improvement of standard of living, urban traffic already becomes increasingly congested. In order to solve the current situation of urban traffic congestion, with the development of railway traffic industry, the light rail is already gradually used in construction of each large city, the vehicle coupler serving as a necessary component for connecting a vehicle plays an important decomposing and coupling role in the railway transport process, and most of the conventional semi-permanent vehicles coupler with or without buffers are directly and fixedly arranged on vehicle bodies through mounting seats; and when decomposition is needed in loading and maintenance or other conditions, the mounting seats or coupler yoke keys must be detached, and the detachment is inconvenient. Meanwhile, a buffer with good conformability with the light rail needs designing.

SUMMARY

The present invention aims to provide a semi-permanent vehicle coupler which is integrally divided into a buffer end and a buffer-free end and is convenient for loading and decomposing aiming at the defects of the prior art.

The present invention adopts the technical scheme that: the semi-permanent vehicle coupler for the light rail comprises a buffer end and a buffer-free end; the buffer end comprises a buffer, a joint bearing connected with the buffer and a mounting seat, wherein the joint bearing is connected with the mounting seat through a coupler yoke key; the buffer-free end comprises a left pull ring, a joint bearing connected with the left pull ring and a mounting seat, wherein the joint bearing is connected with the mounting seat through a coupler yoke key; the buffer is a double-acting buffer and comprises a shell, a left end cover, a right pull ring, elastic bodies, a central shaft and a middle partition plate, wherein the central shaft passes through the centers of the left end cover and the right pull ring and is glidingly contacted with the left end cover and the right pull ring, one end of the central shaft extends out of the left end cover, the middle partition plate is fixedly arranged on the central shaft and divides the inner part of the shell into two elastic body accommodating cavities, and the elastic bodies are positioned in the two elastic body accommodating cavities; and the other end of the left pull ring is provided with a lug boss, one end of the central shaft extending out of the left end cover is also provided with a lug boss, and the two lug bosses are connected through a connecting ring.

Preferably, a convex shim plate is arranged between the elastic body and the left end cover, and a flat shim plate is arranged between the elastic body and the right pull ring, and a conical surface matching mode is adopted between the convex shim plate and the left end cover and between the flat shim plate and the right pull ring.

Preferably, the semi-permanent vehicle coupler for the light rail is provided with stretching overload protection devices, namely the shaft shoulder arranged on the central shaft and the lug boss positioned on the convex shim plate.

Preferably, the semi-permanent vehicle coupler for the light rail is provided with compression overload protection devices, namely the lug boss arranged on the left end cover and a central shaft nut positioned at one end of the central shaft extending out of the left end cover.

Preferably, the vertical locking mode of the coupler yoke key is a pressure plate mode, the pressure plate is fixedly arranged on the mounting seat through a bolt, and one end of the pressure plate presses the coupler yoke key.

Preferably, the lateral surface of the mounting seat is provided with an elastic keeping plate, the other end of the keeping plate is glidingly contacted with the pull ring, and an antifriction pad is arranged between the keeping plate and the pull ring.

Preferably, the vertical locking mode of the coupler yoke key is a pressure plate mode, namely the pressure plate is fixedly arranged on the mounting seat, and one end of the pressure plate presses the coupler yoke key.

The present invention has the advantages that: the semi-permanent vehicle coupler comprises the buffer end and the buffer-free end, and the buffer end and the buffer-free end are connected into a whole through the connecting ring, so loading and necessary decomposition are convenient; the buffer is the double-acting buffer and consists of a stretching side and a compression side, the buffer elements are elastic bodies, two sets of elastic bodies are assembled in the shell by certain pre-pressing force, two sets of buffers are partitioned by the middle partition plate, and the middle partition plate is fixedly connected with the central shaft. The present invention forms a structure that the middle partition plate is driven by front and rear motion of the central shaft to compress the buffer of the stretching side or the compression side, so the buffer effect is good; the conical surface matching mode is adopted between the convex shim plate and the end cover and between the flat shim plate and the pull ring, so the installation is convenient, and it is ensured that the inner hole is not contacted with the central shaft by good positioning between the conical surfaces, so abrasion is avoided; and the overload protection device is provided, the special shaft shoulder of the central shaft is contacted with the lug boss of the convex shim plate in stretching overload to directly transfer the force to the shell, and the nut of the central shaft is contacted with the end cover in compression overload to directly transfer the force to the shell, so the overload protection effect is good. The lateral surface of the mounting seat of each side is provided with the elastic keeping plate, the keeping plate applies a small side pressure from the lateral surface of the pull ring under normal condition to keep the pull ring at a normal position; and when the pull ring needs to deflect (horizontally, vertically or axially) due to an external force, the side pressure applied by the keeping plate can be neglected, and the motion of the pull ring in each direction is not obstructed. Therefore, the pull ring is prevented from generating vibration and noise due to frequent swing or resonance.

DETAILED DESCRIPTION

Figure 1:
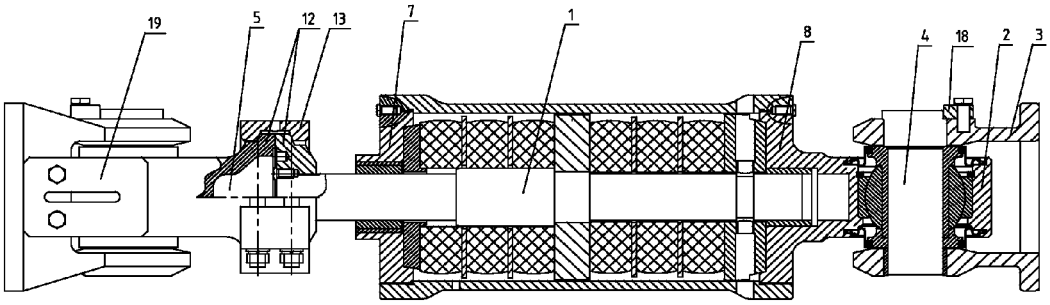
FIG. 1 is a structure diagram of the present invention.
Figure 2:
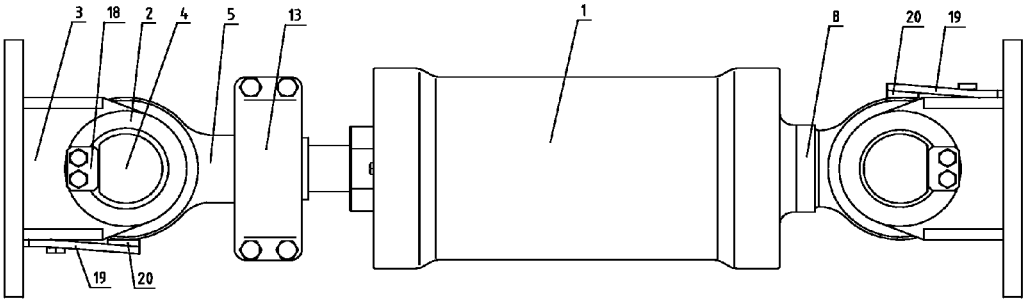
FIG. 2 is a top view of the FIG. 1.
Figure 3:
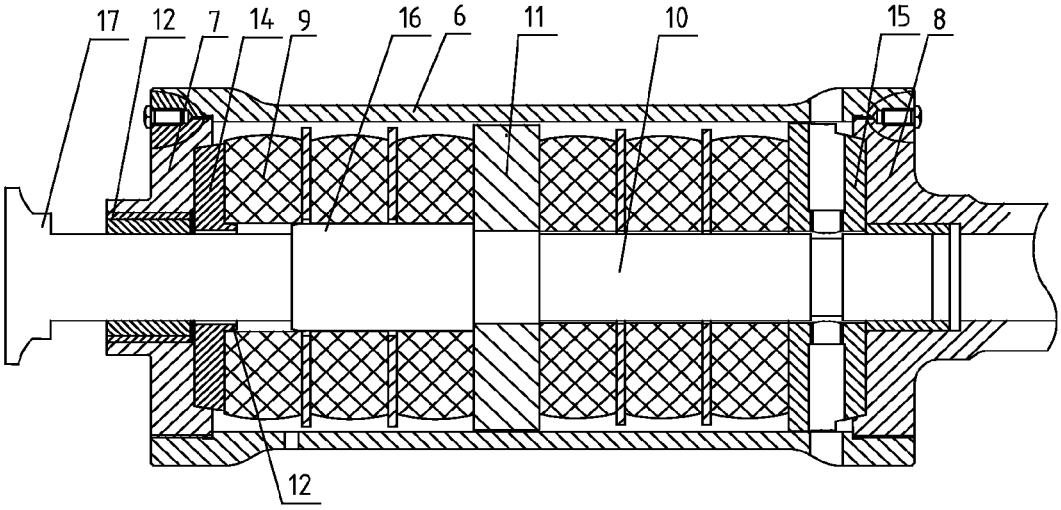
FIG. 3 is a section view structure diagram of the buffer of the present invention.
Figure 4:
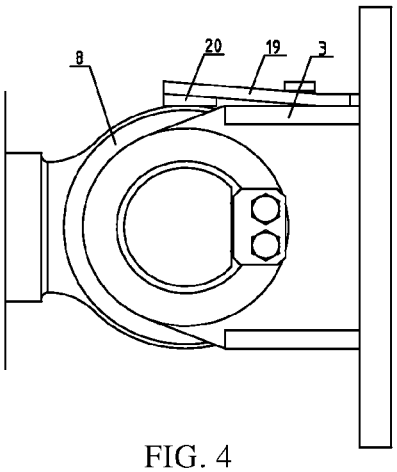
FIG. 4 is a structure diagram of the elastic keeping plate, the mounting seat and the pull ring part of the present invention.

The semi-permanent vehicle coupler for the light rail comprises a buffer end and a buffer-free end; the buffer end comprises a buffer 1, a joint bearing 2 connected with the buffer 1 and a mounting seat 3, wherein the joint bearing 2 is connected with the mounting seat 3 through a coupler yoke key 4; the buffer-free end comprises a left pull ring 5, a joint bearing 2 connected with the left pull ring 5 and a mounting seat 3, wherein the joint bearing 2 is connected with the mounting seat 3 through a coupler yoke key 4; the buffer 1 is a double-acting buffer and comprises a shell 6, a left end cover 7, a right pull ring 8, elastic bodies 9, a central shaft 10 and a middle partition plate 11, wherein the central shaft 10 passes through the centers of the left end cover 7 and the right pull ring 8 and is glidingly contacted with the left end cover 7 and the right pull ring 8, one end of the central shaft 10 extends out of the left end cover 7, the middle partition plate 11 is fixedly arranged on the central shaft 10 and divides the inner part of the shell 6 into two elastic body accommodating cavities, and the elastic bodies 9 are positioned in the two elastic body accommodating cavities; and the other end of the left pull ring 5 is provided with a lug boss 12, one end of the central shaft 10 extending out of the left end cover 7 is also provided with a lug boss 12, and the two lug bosses are connected through a connecting ring 13. A convex shim plate 14 is arranged between the elastic body 9 and the left end cover 7, and a flat shim plate 15 is arranged between the elastic body 9 and the right pull ring 8, and a conical surface matching mode is adopted between the convex shim plate 14 and the left end cover 7 and between the flat shim plate 15 and the right pull ring 8. The semi-permanent vehicle coupler for the light rail is provided with stretching overload protection devices, namely the shaft shoulder 16 arranged on the central shaft 10 and the lug boss 12 positioned on the convex shim plate 14. The semi-permanent vehicle coupler for the light rail is provided with compression overload protection devices, namely the lug boss 12 arranged on the left end cover 7 and a central shaft nut 17 positioned at one end of the central shaft 10 extending out of the left end cover 7. The vertical locking mode of the coupler yoke key 4 is a pressure plate mode, the pressure plate 18 is fixedly arranged on the mounting seat 3 through a bolt, and one end of the pressure plate 18 presses the coupler yoke key 4. The lateral surface of the mounting seat 3 is provided with an elastic keeping plate 19, the other end of the keeping plate 19 is glidingly contacted with the pull ring, and an antifriction pad 20 is arranged between the keeping plate 19 and the pull ring. The vertical locking mode of the coupler yoke key is a pressure plate mode, namely the pressure plate 18 is fixedly arranged on the mounting seat 3, and one end of the pressure plate 18 presses the coupler yoke key 4. In order to be installed to the vehicle conveniently, the semi-permanent vehicle coupler is integrally divided into two parts: a buffer end and a buffer-free end. After being installed to the vehicle respectively, the buffer end and the buffer-free end are connected into a whole through the connecting ring 13.

During operation, the vehicle coupler is often in the following two working conditions:

(1) Traction Working Condition

Under this working condition, the traction force is transferred in a path following the sequence of: the vehicle body, the mounting seat (left), the coupler yoke key, the joint bearing, the left pull ring, the connecting ring, the central shaft, the middle partition plate, the elastic body (stretching side), the convex shim plate, the shell, the right pull rod, the joint bearing (right), the coupler yoke key (right), the mounting seat (right) and the vehicle body. During stretching, the three elastic bodies of the front stretching side bear the buffer capacity.

(2) Compression Working Condition

Under this working condition, the compression force is transferred in a path following the sequence of: the vehicle body, the mounting seat (left), the coupler yoke key, the joint bearing, the left pull ring, the connecting ring, the central pull rod, the middle partition plate, the elastic body (compression side), the flat shim plate, the right pull rod, the joint bearing (right), the coupler yoke key (right), the mounting seat (right) and the vehicle body. During compression, the four elastic bodies of the rear compression side bear the buffer capacity.

What is claimed is:

1. A semi-permanent vehicle coupler for light rail comprising a buffer end and a buffer-free end, wherein the buffer end comprises a buffer, a joint bearing connected with the buffer and a mounting seat, wherein the joint bearing is connected with the mounting seat through a coupler yoke key; the buffer-free end comprises a left pull ring, a joint bearing connected with the left pull ring and a mounting seat, wherein the joint bearing is connected with the mounting seat through a coupler yoke key; the buffer is a double-acting buffer and comprises a shell, a left end cover, a right pull ring, elastic bodies, a central shaft and a middle partition plate, wherein the central shaft passes through the centers of the left end cover and the right pull ring and is glidingly contacted with the left end cover and the right pull ring, one end of the central shaft extends out of the left end cover, the middle partition plate is fixedly arranged on the central shaft and divides the inner part of the shell into two elastic body accommodating cavities, and the elastic bodies are positioned in the two elastic body accommodating cavities; and the other end of the left pull ring is provided with a lug boss, one end of the central shaft extending out of the left end cover is also provided with a lug boss, and the two lug bosses are connected through a connecting ring, wherein a convex shim plate is arranged between the elastic body and the left end cover, and a flat shim plate is arranged between the elastic body and the right pull ring, and a conical surface matching mode is adopted between the convex shim plate and the left end cover and between the flat shim plate and the right pull ring, and wherein the semi-permanent vehicle coupler for light rail is provided with stretching overload protection devices which comprise a shaft shoulder arranged on the central shaft and a lug boss positioned on the convex shim plate.

2. The semi-permanent vehicle coupler for the light rail according to claim 1, wherein the semi-permanent vehicle coupler for light rail is provided with compression overload protection devices which comprise a lug boss arranged on the left end cover and a central shaft nut positioned at one end of the central shaft extending out of the left end cover.

3. The semi-permanent vehicle coupler for the light rail according to claim 1, wherein the semi-permanent vehicle coupler for the light rail is provided with compression overload protection devices which comprise a lug boss arranged on the left end cover and a central shaft nut positioned at one end of the central shaft extending out of the left end cover.

4. The semi-permanent vehicle coupler for the light rail according to claim 1, wherein the vertical locking mode of the coupler yoke key is a pressure plate mode, a pressure plate is fixedly arranged on the mounting seat through a bolt, and one end of the pressure plate presses the coupler yoke key.

5. The semi-permanent vehicle coupler for the light rail according to claim 1, wherein the lateral surface of the mounting seat is provided with an elastic keeping plate, the other end of the keeping plate is glidingly contacted with the pull ring, and an antifriction pad is arranged between the keeping plate and the pull ring.

6. The semi-permanent vehicle coupler for the light rail according to claim 1, wherein the vertical locking mode of the coupler yoke key is a pressure plate mode, a pressure plate is fixedly arranged on the mounting seat, and one end of the pressure plate presses the coupler yoke key.

7. A semi-permanent vehicle coupler for light rail comprising a buffer end and a buffer-free end, wherein the buffer end comprises a buffer, a joint bearing connected with the buffer and a mounting seat, wherein the joint bearing is connected with the mounting seat through a coupler yoke key; the buffer-free end comprises a left pull ring, a joint bearing connected with the left pull ring and a mounting seat, wherein the joint bearing is connected with the mounting seat through a coupler yoke key; the buffer is a double-acting buffer and comprises a shell, a left end cover, a right pull ring, elastic bodies, a central shaft and a middle partition plate, wherein the central shaft passes through the centers of the left end cover and the right pull ring and is glidingly contacted with the left end cover and the right pull ring, one end of the central shaft extends out of the left end cover, the middle partition plate is fixedly arranged on the central shaft and divides the inner part of the shell into two elastic body accommodating cavities, and the elastic bodies are positioned in the two elastic body accommodating cavities; and the other end of the left pull ring is provided with a lug boss, one end of the central shaft extending out of the left end cover is also provided with a lug boss, and the two lug bosses are connected through a connecting ring, wherein the semi-permanent vehicle coupler for light rail is provided with compression overload protection devices which comprise a lug boss arranged on the left end cover and a central shaft nut positioned at one end of the central shaft extending out of the left end cover.

8. The semi-permanent vehicle coupler for the light rail according to claim 7, wherein a convex shim plate is arranged between the elastic body and the left end cover, and a flat shim plate is arranged between the elastic body and the right pull ring, and a conical surface matching mode is adopted between the convex shim plate and the left end cover and between the flat shim plate and the right pull ring.

9. The semi-permanent vehicle coupler for the light rail according to claim 8, wherein the semi-permanent vehicle coupler for light rail is provided with stretching overload protection devices which comprise a shaft shoulder arranged on the central shaft and a lug boss positioned on the convex shim plate.

10. The semi-permanent vehicle coupler for the light rail according to claim 8, wherein the semi-permanent vehicle coupler for the light rail is provided with compression overload protection devices which comprise a lug boss arranged on the left end cover and a central shaft nut positioned at one end of the central shaft extending out of the left end cover.

11. The semi-permanent vehicle coupler for the light rail according to claim 7, wherein the vertical locking mode of the coupler yoke key is a pressure plate mode, a pressure plate is fixedly arranged on the mounting seat through a bolt, and one end of the pressure plate presses the coupler yoke key.

12. The semi-permanent vehicle coupler for the light rail according to claim 7, wherein the lateral surface of the mounting seat is provided with an elastic keeping plate, the other end of the keeping plate is glidingly contacted with the pull ring, and an antifriction pad is arranged between the keeping plate and the pull ring.

13. The semi-permanent vehicle coupler for the light rail according to claim 7, wherein the vertical locking mode of the coupler yoke key is a pressure plate mode, a pressure plate is fixedly arranged on the mounting seat, and one end of the pressure plate presses the coupler yoke key.

14. A semi-permanent vehicle coupler for light rail comprising a buffer end and a buffer-free end, wherein the buffer end comprises a buffer, a joint bearing connected with the buffer and a mounting seat, wherein the joint bearing is connected with the mounting seat through a coupler yoke key; the buffer-free end comprises a left pull ring, a joint bearing connected with the left pull ring and a mounting seat, wherein the joint bearing is connected with the mounting seat through a coupler yoke key; the buffer is a double-acting buffer and comprises a shell, a left end cover, a right pull ring, elastic bodies, a central shaft and a middle partition plate, wherein the central shaft passes through the centers of the left end cover and the right pull ring and is glidingly contacted with the left end cover and the right pull ring, one end of the central shaft extends out of the left end cover, the middle partition plate is fixedly arranged on the central shaft and divides the inner part of the shell into two elastic body accommodating cavities, and the elastic bodies are positioned in the two elastic body accommodating cavities; and the other end of the left pull ring is provided with a lug boss, one end of the central shaft extending out of the left end cover is also provided with a lug boss, and the two lug bosses are connected through a connecting ring, wherein the vertical locking mode of the coupler yoke key is a pressure plate mode, a pressure plate is fixedly arranged on the mounting seat through a bolt, and one end of the pressure plate presses the coupler yoke key.

15. The semi-permanent vehicle coupler for the light rail according to claim 14, wherein a convex shim plate is arranged between the elastic body and the left end cover, and a flat shim plate is arranged between the elastic body and the right pull ring, and a conical surface matching mode is adopted between the convex shim plate and the left end cover and between the flat shim plate and the right pull ring.

16. The semi-permanent vehicle coupler for the light rail according to claim 15, wherein the semi-permanent vehicle coupler for light rail is provided with stretching overload protection devices which comprise a shaft shoulder arranged on the central shaft and a lug boss positioned on the convex shim plate.

17. The semi-permanent vehicle coupler for the light rail according to claim 15, wherein the semi-permanent vehicle coupler for the light rail is provided with compression overload protection devices which comprise a lug boss arranged on the left end cover and a central shaft nut positioned at one end of the central shaft extending out of the left end cover.

18. The semi-permanent vehicle coupler for the light rail according to claim 14, wherein the semi-permanent vehicle coupler for light rail is provided with compression overload protection devices which comprise a lug boss arranged on the left end cover and a central shaft nut positioned at one end of the central shaft extending out of the left end cover.

19. The semi-permanent vehicle coupler for the light rail according to claim 14, wherein the lateral surface of the mounting seat is provided with an elastic keeping plate, the other end of the keeping plate is glidingly contacted with the pull ring, and an antifriction pad is arranged between the keeping plate and the pull ring.

20. The semi-permanent vehicle coupler for the light rail according to claim 14, wherein the vertical locking mode of the coupler yoke key is a pressure plate mode, a pressure plate is fixedly arranged on the mounting seat, and one end of the pressure plate presses the coupler yoke key.

* * * * *